US007044571B2

(12) United States Patent
Smith et al.

(10) Patent No.: US 7,044,571 B2ë
(45) Date of Patent: May 16, 2006

(54) POWER SUPPLY ADJUSTMENT

(75) Inventors: Glenn Michael Smith, Vancouver, WA (US); Robert James Ray, Corbett, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 175 days.

(21) Appl. No.: 10/695,508

(22) Filed: Oct. 28, 2003

(65) Prior Publication Data

US 2005/0088466 A1 Apr. 28, 2005

(51) Int. Cl.
*B41J 29/38* (2006.01)

(52) U.S. Cl. ..... 347/10

(58) Field of Classification Search ..... 347/10, 347/11, 50, 9, 57, 59, 128; 328/282, 351
See application file for complete search history.

(56) References Cited

U.S. PATENT DOCUMENTS 4,835,669 A * 5/1989 Hancock et al. ..... 363/21.17
5,258,903 A 11/1993 Rodriguez-Cavazos
5,293,077 A 3/1994 Seki et al.
5,371,666 A 12/1994 Miller
5,414,340 A 5/1995 Gannon
5,526,027 A * 6/1996 Wade et al. ..... 347/14
5,541,628 A * 7/1996 Chang et al. ..... 347/10
5,828,558 A 10/1998 Korcharz et al.
5,831,837 A 11/1998 Coyne et al.
6,060,388 A * 5/2000 Akatsu et al. ..... 438/637
6,137,274 A 10/2000 Rajagopalan
6,320,768 B1 11/2001 Pham et al.
2004/0223271 A1* 11/2004 Ivankovic ..... 361/23

FOREIGN PATENT DOCUMENTS

EP 0871285 6/2003
WO WO98/38726 9/1998

* cited by examiner

*Primary Examiner*—Shih-Wen Hsieh

(57) ABSTRACT

In an implementation of power supply adjustment, a power supply generates an output to a powered device that generates a control signal which is input to an adjustment circuit that generates a difference signal to adjust the output of the power supply.

35 Claims, 5 Drawing Sheets

POWER SUPPLY ADJUSTMENT

BACKGROUND

An imaging device, such as a printing device, typically has an AC to DC power supply to power the various components of the device. For example, a printing device has a print cartridge with a printhead to apply an imaging medium to a print media. The printhead has one or more pens that are turned on and off to apply the imaging medium to the print media. Pen turn-on energy is closely controlled in a printing device in an effort to ensure high-quality printouts. Some of the variables of pen turn-on energy include an operating temperature, how long a pen has been in service, and manufacturing variations and tolerances. Variations in the power supply output voltage can affect the pen turn-on energy which can result in a degradation of print quality or a shorter printhead life.

BRIEF DESCRIPTION OF THE DRAWINGS

The same numbers are used throughout the drawings to reference like features and components.

DETAILED DESCRIPTION

The following describes power supply adjustment which can be implemented to adjust an output generated by a power supply. In an exemplary implementation, power supply adjustment can be implemented in a printing device in which all of the powered components of the printing device, including one or more printhead pens, are powered from a single power rail coupled to the power supply. A power supply voltage output can be adjusted for a desired pen turn-on energy and the rest of the powered components in the printing device operate at the adjusted voltage level.

Figure 1:
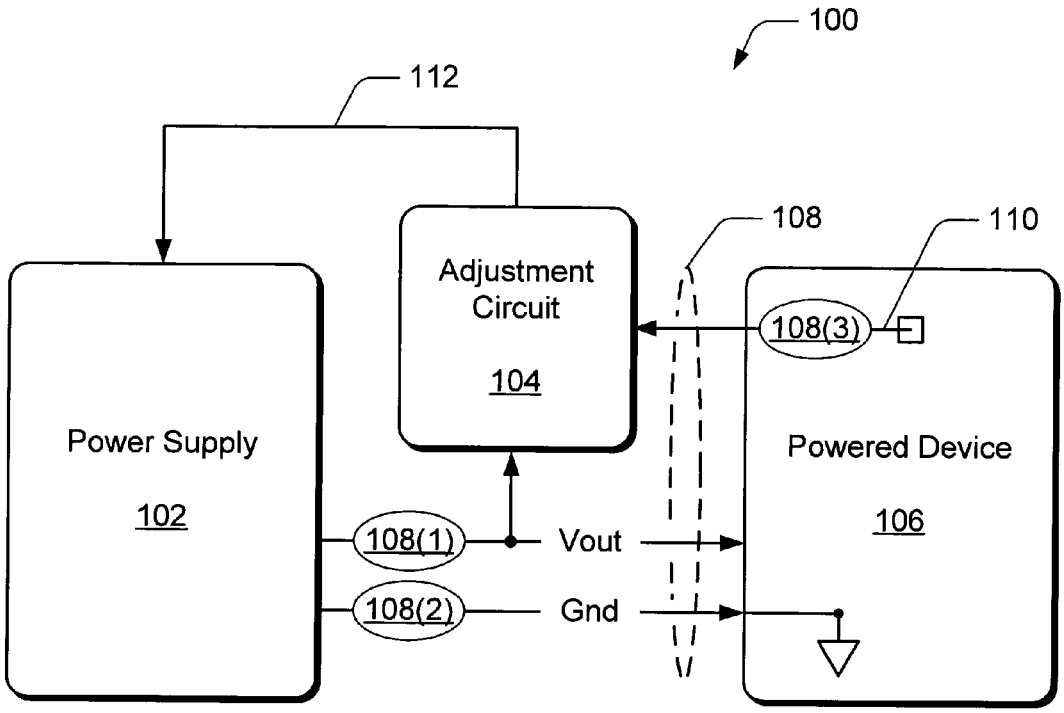
FIG. 1 illustrates an embodiment of a power supply adjustment system.

FIG. 1 illustrates an embodiment of a power supply adjustment system 100 that includes a power supply 102, an adjustment circuit 104, and a powered device 106. The powered device 106 can include any type of electronic, imaging, and/or computing device that is powered with a power supply, such as the exemplary printing device 500 which is described below with reference to FIG. 5. Printing device 500 includes examples of components that may be coupled to power supply 102 for operational power. For example, a printing device includes a print module, or cartridge, that has a printhead to apply an imaging medium to a print media. The printhead has one or more pens that are coupled to the power supply which controls variations of pen turn-on energy.

In this example, the power supply 102 is coupled to powered device 106 via a multi-wire connection 108 that includes an output voltage (Vout) 108(1) which provides power to the powered device 106 and an input to the adjustment circuit 104. The multi-wire connection also includes a second connection, such as ground connection 108(2), and a third connection 108(3) through which the adjustment circuit 104 is integrated. The multi-wire connection 108 can be implemented to include any number of output voltages and ground connections, such as for a system 100 in which power supply 102 provides power to multiple powered devices.

Although the adjustment circuit 104 is illustrated and described as an independent component in this example, the adjustment circuit 104 can also be implemented as a component of the power supply 102, as a component of the powered device 106, or as one or more components of each of the power supply 102 and the powered device 106. Furthermore, powered device 106 may include the multi-wire connection 108 and the power supply 102 as an internal power supply. In such an implementation, the multi-wire connection 108 can also be configured as a circuit board to circuit board connector, or as any number of other different types of electrical component connections.

The adjustment circuit 104 receives a control signal 110 from powered device 106 via the multi-wire connection 108(3). The adjustment circuit 104 generates a difference signal from the control signal 110. A feedback signal 112 is derived from a feedback network for output voltage (Vout) adjustment and regulation. The feedback signal 112 is applied to the power supply 102 to vary or adjust (e.g., set) the output voltage (Vout). In one embodiment, the difference signal can be increased or decreased so that the feedback signal 112 varies, but reaches a specified value (e.g., a steady state) to regulate the output voltage to a desired value. In an embodiment described with reference to *Fig.* 1, the control signal 110 can be a pulse width modulated control signal generated by powered device 106 the difference signal can be a difference voltage, and the feedback signal can be a feedback voltage.

Figure 2:
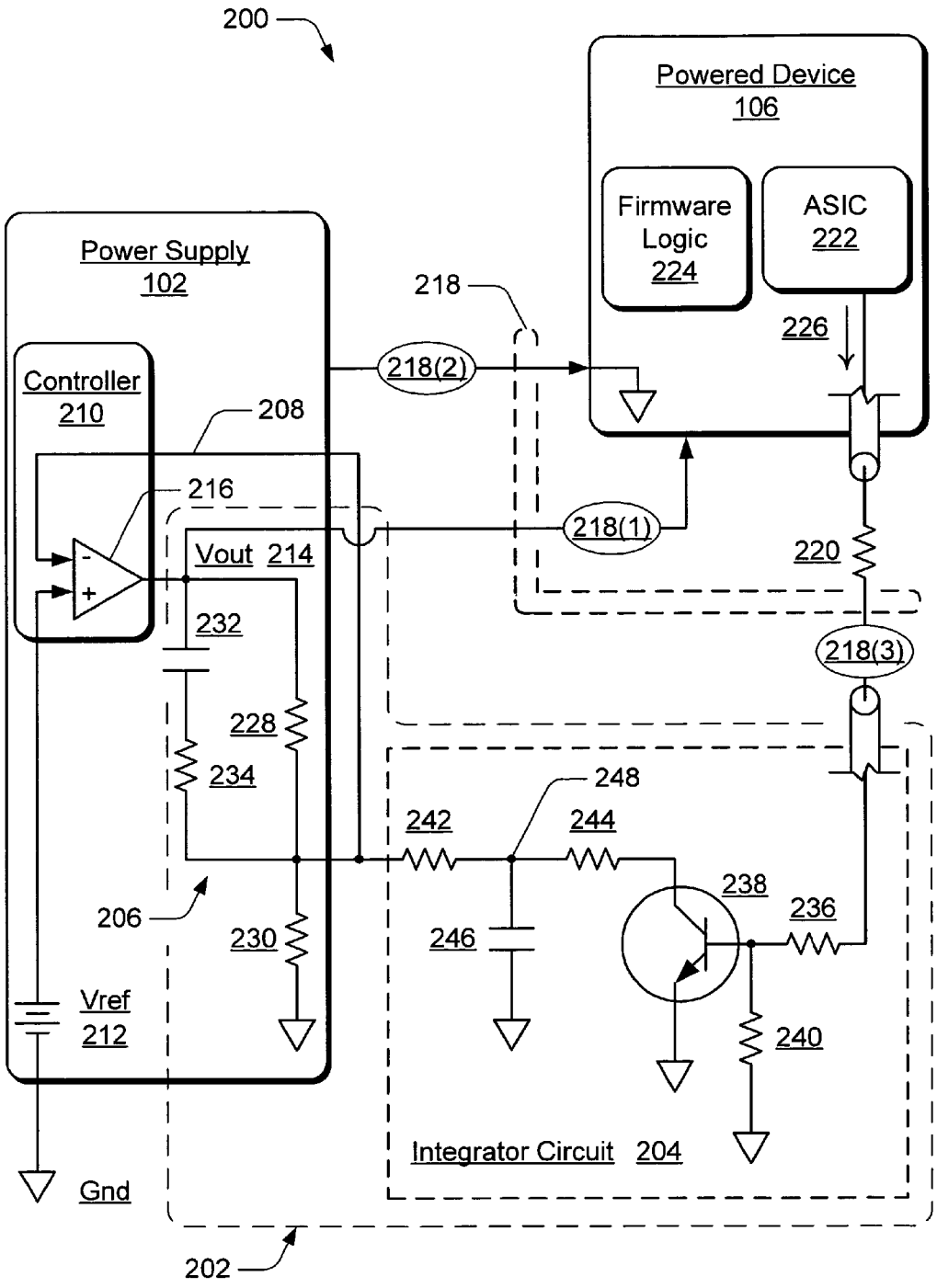
FIG. 2 illustrates an embodiment of a power supply voltage adjustment system.

FIG. 2 illustrates an embodiment of a power supply voltage adjustment system 200 that includes power supply 102, powered device 106, and a voltage adjustment circuit 202. The voltage adjustment circuit 202 includes an embodiment of an integrator circuit 204 that generates a difference voltage, and includes a feedback network 206 (e.g., in power supply 102) that generates a feedback voltage 208 to the power supply 102. Other embodiments of integrator circuits may be implemented to perform the function(s) of integrator circuit 204.

The power supply 102 includes a controller 210 that receives the feedback voltage 208 and which is connected to a reference voltage (Vref) 212. The power supply 102 generates an output voltage (Vout) 214 which is regulated (e.g., varied or adjusted) according to the feedback voltage 208. In operation (represented by an indicator 216), power supply 102 receives the reference voltage (Vref) 212 as a positive input (e.g., as a positive potential), receives the feedback voltage 208 as a negative input (e.g., as a negative potential), and generates Vout 214 based on the two inputs and/or based on a difference of potential between the two inputs.

The power supply 102 is coupled to powered device 106 via a multi-wire connection 218 that includes, in this example, a Vout connection 218(1), a ground connection 218(2), and a third connection 218(3) that has an inherent resistance 220 and which is coupled through the integrator circuit 204 to the feedback network 206 from which the feedback voltage 208 is derived. In an embodiment, the powered device 106 can include an application-specific integrated circuit (ASIC) 222 and firmware logic 224.

The ASIC 222 can be implemented with analog-to-digital converters, for example, to monitor the power supply voltage (i.e., Vout 214) for the desired operation of one or more powered components in the powered device 106. The ASIC 222 generates a pulse width modulated control signal 226 for input to the integrator circuit 204. In one embodiment, a firmware component, for example, may be implemented as a permanent memory module in the powered device 106 to maintain the firmware logic 224 as computer executable instructions to adjust the pulse width modulated control signal 226 until a desired Vout 214 measured with ASIC 222 is obtained.

In one embodiment, a desired Vout 214 can be based on the optical detection of ink drops that are applied to a print media test page such as when a pen is replaced and powered on or when a test page is initiated. The ink drops can be evaluated optically to determine a desired print quality that corresponds to a particular Vout 214. The pulse width modulated control signal 226 can be adjusted accordingly to generate the particular Vout 214 that produces the desired print quality.

The feedback network 206 includes resistors 228 and 230 that form a voltage divider network which divides Vout 214 down to the feedback voltage 208 that is input to controller 210 in the power supply 102 to regulate Vout 214. The feedback network 206 also includes a capacitor 232 and a resistor 234 that are additional components to reduce voltage overshoot when the power supply 102 is first powered on. Power supply adjustment can be implemented such that the power supply 102 is adjustable via the pulse width modulated control signal 226 generated by ASIC 222 in the powered device 106.

The integrator circuit 204 includes a resistor 236, a transistor 238, and a transistor pull-down resistor 240. The integrator circuit 204 receives the pulse width modulated control signal 226 from the powered device 106 via the connection 218(3). The resistor 236 limits the current driving the base of transistor 238 which buffers the pulse width modulated control signal 226. The pull-down resistor 240 provides that the base of transistor 238 is pulled to ground which shuts off the transistor 238 in the absence of a pulse width modulated control signal (e.g., control signal 226).

Buffering the control signal 226 with transistor 238 provides that the integrator circuit 204 is less affected by DC offsets, or voltage level variations, that may occur when the control signal 226 is received via connection 218(3) (e.g., by resistive property 220). In one embodiment, transistor 238 can be implemented as a bi-polar junction transistor (BJT) which provides that the control signal 226 is inverted such that during initial power-up of power supply 102, the power-up voltage will be at the lowest voltage available on output from the power supply. In another embodiment, transistor 238 can be implemented as a field effect transistor (FET).

Adjusting the pulse width modulated control signal 226 increases the output voltage 214. If the control signal 226 is disabled or disconnected for any reason, the power supply output voltage 214 will drop to the lowest voltage available on output from the power supply 102. Resistor component values of the integrator circuit 204 and/or resistor component values of the feedback network 206 can be selected to control the maximum voltage available on output from the power supply 102 which provides that the maximum voltage output can be set to a safe level for the electronic components of the powered device 106 and for users of the powered device.

The integrator circuit 204 also includes a resistor 242 and a DC filter formed with a resistor 244 and a capacitor 246 that filters the pulse width modulated control signal 226. The DC filter generates a difference voltage at node 248. A difference between the difference voltage 248 and the feedback voltage 208 causes a current to flow which decreases the feedback voltage 208. When the controller 210 in power supply 102 receives a lower feedback voltage 208, Vout 214 is increased to compensate for what appears to be a low power supply output voltage. The controller 210 increases Vout 214 until the feedback voltage 208 matches a reference voltage (e.g., Vref 212) of the controller 210. The difference voltage 248 changes according to the pulse width modulated control signal 226 which causes Vout 214 to change such that feedback voltage 208 stabilizes.

The capacitor 232 and resistor 234 in power supply 102 form a compensation network (RC time constant) that reduces output voltage overshoot at power supply start up to maintain a safe voltage level. At start up, there is a temporary current path through resistor 242 and capacitor 246 in parallel with resistor 230. When capacitor 246 reaches a steady state after start up, the temporary current path is no longer available and the integrator circuit 204 only has a current path through resistor 230 to ground (that is until the pulse width modulated control signal 226 is generated by the powered device 106).

The following describes an example of a specific implementation of the integrator circuit 204 and the feedback network 206 which includes component values of the circuit components. This example should not be construed as a limitation, but rather as just one example of component sizing to implement power supply adjustment. The powered components in the embodiment of printing device 500 (described below with reference to FIG. 5.) can be implemented to operate at approximately 32 volts.

The power supply 102 can be coupled to one or more power rails in the printing device 500 to provide power (e.g., optionally multiple Vouts) to all of the components of the printing device. The one or more pens of a printhead operate at approximately 29 to 32 volts, depending upon manufacturing constraints and tolerances. Different pens in a single device or in different devices may operate in a desired manner at slightly different voltage levels. Accordingly, the desired operating voltage for the pen(s) of a particular printing device can be adjusted with power supply voltage adjustment such that the other components of the printing device will still operate at the adjusted pen voltage.

The power supply 102 can be implemented to be controlled by a 3.3 volt peak-to-peak 20 KHz pulse width modulated control signal having a varying duty cycle from 0–100%. The minimum power supply output voltage is 26.5 volts and the maximum power supply output voltage is 33.5 volts (not to be exceeded on start up). The minimum power supply output voltage of 26.5 volts is output at power up and anytime that the pulse width modulated control signal 226 is not present, or received as feedback. A 5 volt reference voltage (e.g., Vref 212) is applied to the power supply controller 210 for feedback regulation.

The component value of resistor 228 can be selected as a value that is large enough to limit the current through the voltage divider network formed with resistors 228 and 230. For this example, the component value of resistor 228 is selected as a 30K ohms. The component value of resistor 230 is then determined by the following:

$$Vout(\min)\times\frac{R230}{R228+R230}=V_{ref}=Vfeedback$$

$$26.5\ \text{volts}\times\frac{R230}{30K\ \text{ohms}+\text{R}230}=5\ \text{volts}$$

Accordingly, the component value of resistor 230 is approximately 7K ohms. The minimum output voltage (26.5 volts) is used to determine the component value of resistor 230 because this is the output voltage at power up and at anytime that the pulse width modulated control signal 226 is not present, or received as feedback.

The transistor 238 can be implemented with a commonly available 2N3904 BJT that has a collector current rating of 200 mA and a collector-to-emitter voltage rating of 40 volts DC. The component values of resistors 242 and 244 are determined based on transistor 238 being turned on such that there is a current path through resistors 242 and 244 in parallel with resistor 230 to ground. Resistors 242 and 244 are combined to form a series resistance, R-series, which is determined by the following:

$$Vout(\max)\times\frac{R230\ //\ R\text{-series}}{(R228+R230)\ //\ R\text{-series}}=V_{ref}$$

$$33.5\ \text{volts}\times\frac{7K\ \text{ohms}\ //\ R\text{-series}}{(30K\ \text{ohms}+7K\ \text{ohms})\ //\ R\text{-series}}=5\ \text{volts}$$

Accordingly, the series resistance, R-series (resistors 242 and 244), is 21.4K ohms. An approximate 3-to-1 ratio can be used to select component values of the resistors 242 and 244, such that R 242=1/3 R 244. Utilizing standard resistor component values, resistor 241 is approximately 5.1 K ohms and resistor 244 is approximately 16.2K ohms.

Each of resistor 236 and resistor 240 can be implemented as a 10K ohm resistor. Resistor 236 is implemented as a transistor 238 base current limiting resistor, and resistor 240 is implemented as a transistor 238 pull-down resistor. The component value of capacitor 246 can be determined by the following:

$$Cap246=\frac{1}{2\pi f\times[(R242+R228\ //\ R230)\ //\ R244]}$$

At a 20 KHz frequency, the component value of capacitor 246 is then 1.2 uF.

The RC compensation network formed with resistor 234 and capacitor 232 is implemented to reduce output voltage overshoot at power supply start up to maintain a safe voltage level. The compensation network changes the impedance of the feedback network on start up such that more current flows and capacitor 232 charges quickly. When capacitor 232 is fully charged, the power supply output voltage reaches the desired turn-on voltage set by resistors 228 and 230 without output voltage overshoot.

The component values of capacitor 232 and resistor 234 are selected such that a time constant (T1) for the current path through capacitor 232 and resistor 234 is much faster than a time constant (T2) for a current path that excludes the capacitor 232 and resistor 234. The component value of capacitor 232 can be determined by the following:

$$T1<T2$$

$$T1=[([(Zc232+R234)//R228]//R230)+R242]\times C246$$

$$T2=[(R228//R230)+R242]\times C246$$

where Zc is a frequency dependent impedance of a feed-forward capacitor 232 determined by the equation: Zc=1/jωC where ω=2πf. The resistor 234 and capacitor 232 network can also be implemented with a single feed-forward capacitor.

Figure 3:
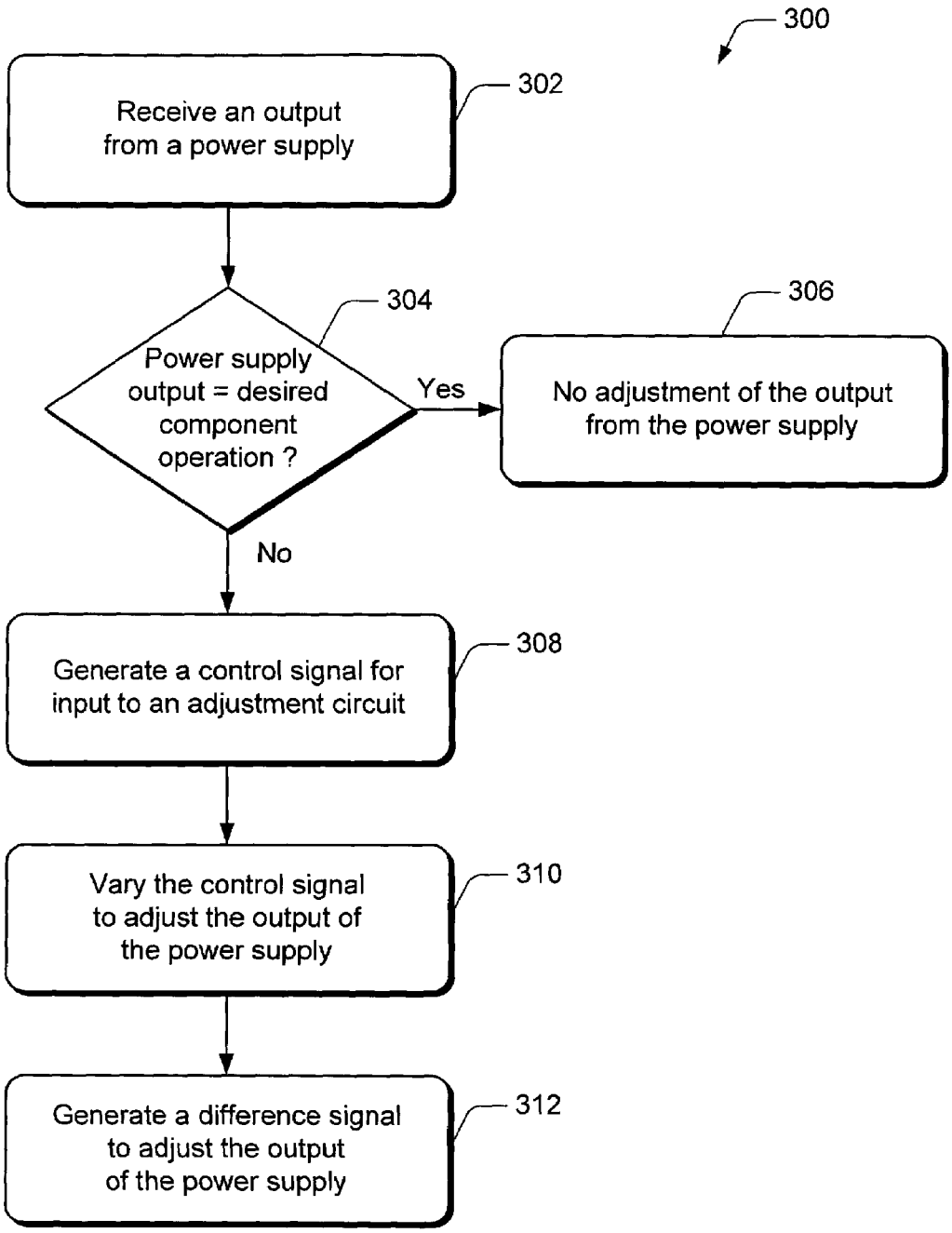
FIG. 3 is a flow diagram that illustrates an embodiment of a method for power supply adjustment.

FIG. 3 illustrates an embodiment of a method 300 for power supply adjustment. The order in which the method is described is not intended to be construed as a limitation, and any number of the described method blocks can be combined in any order to implement the method. Furthermore, the method can be implemented in any suitable hardware, software, firmware, or combination thereof.

At block 302, an output is received from a power supply. For example, power supply 102 (FIG. 1) generates an output that is received by the powered device 106. At block 304, a determination is made as to whether the output corresponds to desired component operation. For example, powered device 106 monitors the output and operation of one or more components of the powered device 106.

If the output does correspond to desired component operation (i.e., "yes" from block 304), then there is no adjustment to the output from the power supply at block 306. If the output does not correspond to desired component operation (i.e., "no" from block 304), then a control signal is generated for input to an adjustment circuit at block 308. For example, powered device 106 (FIG. 1) generates the control signal 110 for input to the adjustment circuit 104.

At block 310, the control signal is varied to adjust the output received from the power supply. For example, the powered device 106 can vary the control signal 110 to adjust (e.g., increase or decrease) the output from the power supply 102.

At block 312, a difference signal is generated to adjust the output of the power supply. For example, the adjustment circuit 104 generates a difference signal that is applied to a feedback network from which the feedback signal 112 is generated and applied to the power supply to adjust (e.g., increase or decrease) the output of the power supply 102. The adjustment circuit 104 can generate the feedback signal 112 by dividing the output down to the feedback signal with a voltage divider circuit, buffering the control signal with a buffer circuit, and filtering the control signal with a DC filter to generate the difference signal. Further, the adjustment circuit 104 reduces the output from the power supply 102 during start up of the power supply with an RC time constant circuit.

Figure 4:
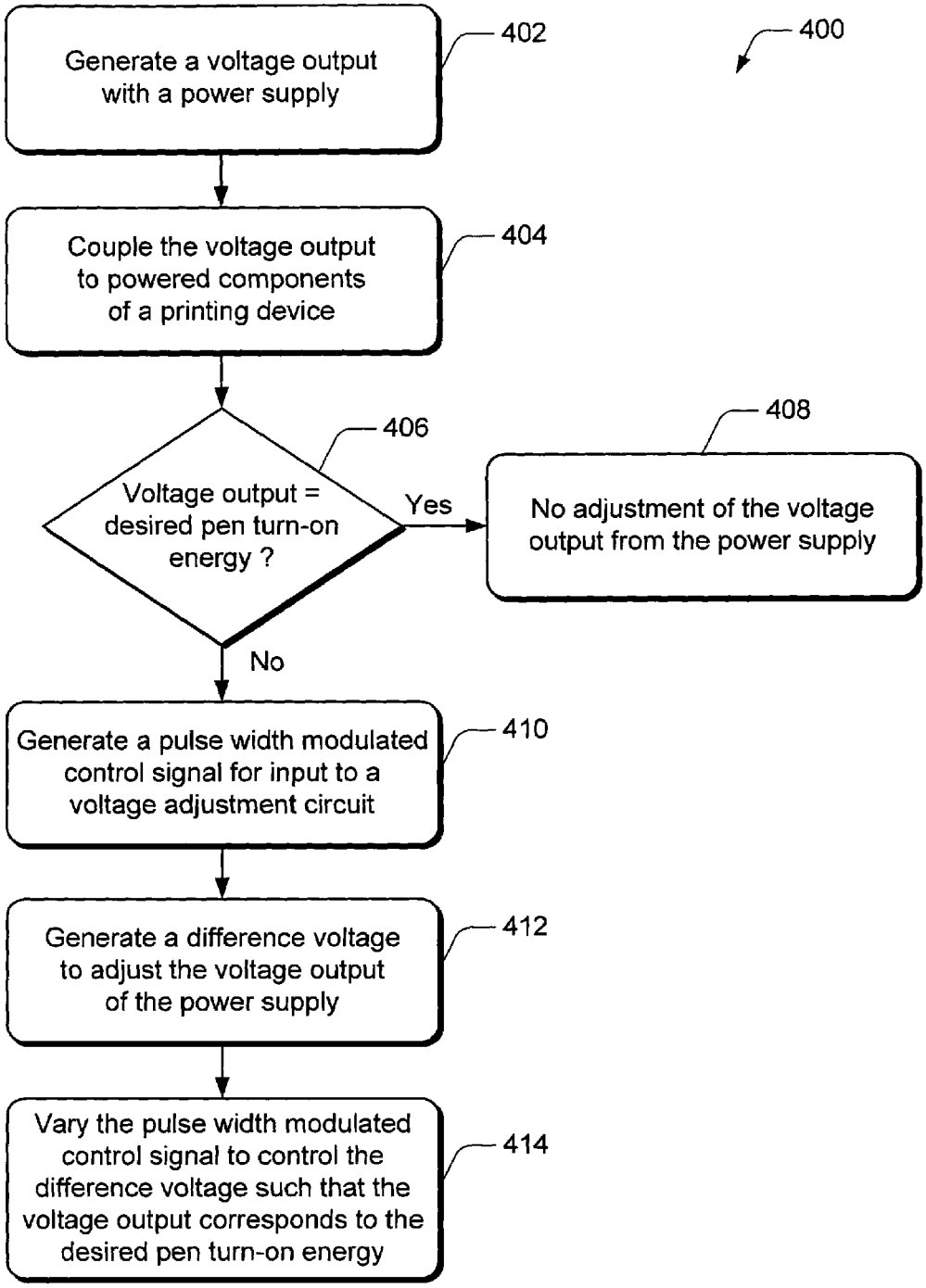
FIG. 4 is a flow diagram that illustrates an embodiment of a method for power supply adjustment implemented in a printing device.

FIG. 4 illustrates an embodiment of a method 400 for power supply adjustment implemented in a printing device. The order in which the method is described is not intended to be construed as a limitation, and any number of the described method blocks can be combined in any order to implement the method. Furthermore, the method can be implemented in any suitable hardware, software, firmware, or combination thereof.

At block 402, a voltage output is generated with a power supply. For example, power supply 102 (FIG. 2) generates a voltage output (Vout) 214. At block 404, the voltage output is coupled to powered components of a printing device. For example, Vout 214 can be coupled to powered components of a printing device 500 (e.g., powered device 106 (FIG. 2)) which includes one or more pens that deposit an imaging medium on a print media when the voltage output is applied.

At block 406, a determination is made as to whether the voltage output corresponds to a desired pen turn-on energy. If the voltage output does correspond to the desired pen turn-on energy (i.e., "yes" from block 406), then there is no adjustment to the voltage output from the power supply at block 408. If the voltage output does not correspond to the desired pen turn-on energy (i.e., "no" from block 406), then a pulse width modulated control signal is generated for input to a voltage adjustment circuit at block 410. For example, powered device 106 (FIG. 2) generates the pulse width modulated control signal 226 for input to the exemplary integrator circuit 204.

At block 412, a difference voltage is generated to adjust the voltage output of the power supply. For example, the integrator circuit 204 (FIG. 2) generates difference voltage 248 to increase or decrease the voltage output of the power supply 102. The feedback network 206 divides the voltage output (Vout) 214 down to a feedback voltage 208 with a voltage divider circuit. The integrator circuit 204 buffers the pulse width modulated control signal 226 with a buffer circuit, and filters the pulse width modulated control signal 226 with a DC filter to generate the difference voltage 248.

At block 414, the pulse width modulated control signal is varied to control the difference voltage such that the voltage output received from the power supply corresponds to the desired pen turn-on energy. For example, the powered device 106 (FIG. 2) (e.g., a printing device 500) varies the pulse width modulated control signal 226 to generate difference voltage 248 which adjusts the voltage output 214 received from the power supply 102 such that one or more pens of the printing device 500 operate at an optimal pen turn-on energy.

Figure 5:
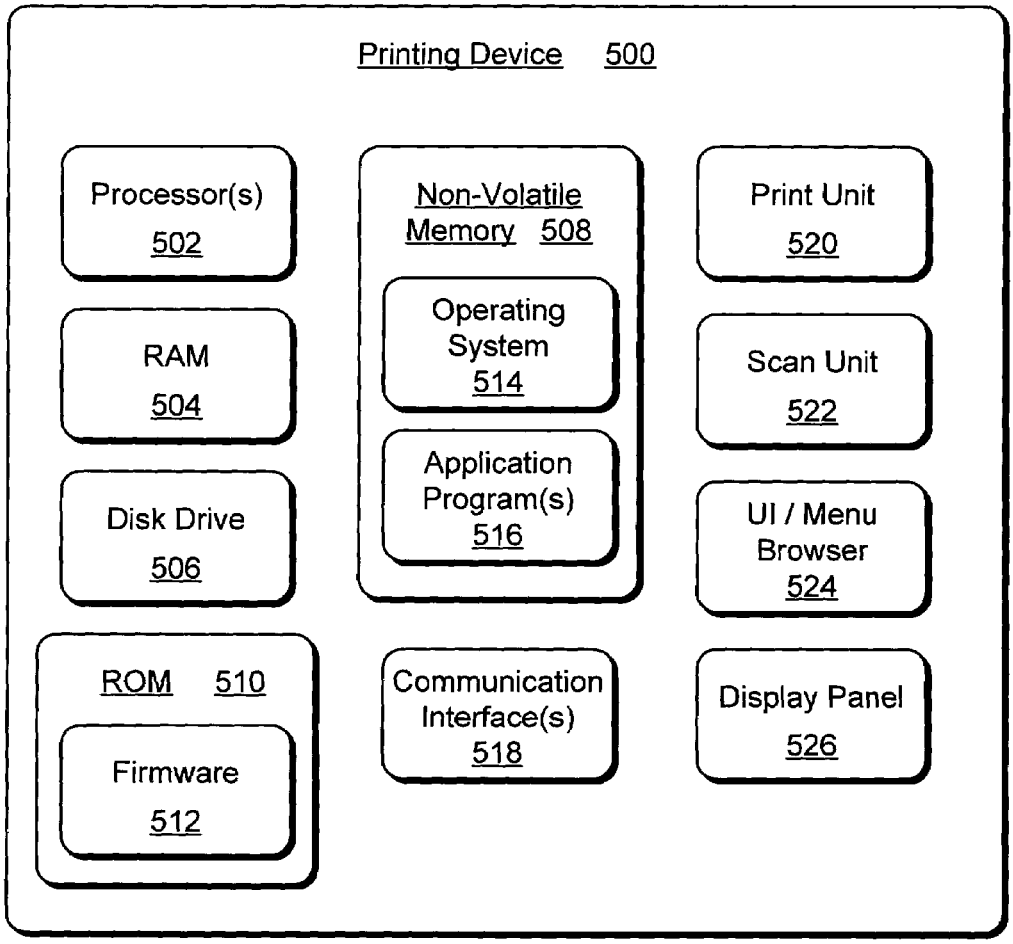
FIG. 5 illustrates various components of an embodiment of a printing device in which power supply adjustment can be implemented.

FIG. 5 illustrates various components of an embodiment of a printing device 500 in which power supply adjustment can be implemented. General reference is made herein to one or more printing devices, such as printing device 500. As used herein, "printing device" means any electronic device having data communications, data storage capabilities, and/or functions to render printed characters, text, graphics, and/or images on a print media. A printing device may be a printer, fax machine, copier, plotter, and the like. The term "printer" includes any type of printing device using a transferred imaging medium, such as ejected ink, to create an image on a print media. Examples of such a printer can include, but are not limited to, inkjet printers, electrophotographic printers, plotters, portable printing devices, as well as all-in-one, multi-function combination devices.

Printing device 500 may include one or more processors 502 (e.g., any of microprocessors, controllers, and the like) which process various instructions to control the operation of printing device 500 and to communicate with other electronic and computing devices.

Printing device 500 can be implemented with one or more memory components, examples of which include random access memory (RAM) 504, a disk drive 506, and non-volatile memory 508 (e.g., any one or more of a ROM 510, flash memory, EPROM, EEPROM, etc.). The one or more memory components store various information and/or data such as configuration information, print job information and data, graphical user interface information, fonts, templates, menu structure information, and any other types of information and data related to operational aspects of printing device 500.

Printing device 500 includes a firmware component 512 that is implemented as a permanent memory module stored on ROM 510, or with other components in printing device 500, such as a component of a processor 502. Firmware 512 is programmed and distributed with printing device 500 to coordinate operations of the hardware within printing device 500 and contains programming constructs used to perform such operations.

An operating system 514 and one or more application programs 516 can be stored in non-volatile memory 508 and executed on processor(s) 502 to provide a runtime environment. A runtime environment facilitates extensibility of printing device 500 by allowing various interfaces to be defined that, in turn, allow application programs 516 to interact with printing device 500.

Printing device 500 further includes one or more communication interfaces 518 which can be implemented as any one or more of a serial and/or parallel interface, a wireless interface, any type of network interface, and as any other type of communication interface. A wireless interface enables printing device 500 to receive control input commands and other information from an input device, such as from an infrared (IR), 802.11, Bluetooth, or similar RF input device. A network interface provides a connection between printing device 500 and a data communication network which allows other electronic and computing devices coupled to a common data communication network to send print jobs, menu data, and other information to printing device 500 via the network. Similarly, a serial and/or parallel interface provides a data communication path directly between printing device 500 and another electronic or computing device.

Printing device 500 also includes a print unit 520 that includes mechanisms arranged to selectively apply an imaging medium such as liquid ink, toner, and the like to a print media in accordance with print data corresponding to a print job. For example, print unit 520 can include a print module, or cartridge, that has a printhead with one or more pens to apply the imaging medium to the print media. The print media can include any form of media used for printing such as paper, plastic, fabric, Mylar, transparencies, and the like, and different sizes and types such as 8½×11, A4, roll feed media, etc.

Printing device 500, when implemented as an all-in-one device for example, can also include a scan unit 522 that can be implemented as an optical scanner to produce machine-readable image data signals that are representative of a scanned image, such as a photograph or a page of printed text. The image data signals produced by scan unit 522 can be used to reproduce the scanned image on a display device or with a printing device.

Printing device 500 also includes a user interface and menu browser 524 and a display panel 526. The user interface and menu browser 524 allows a user of printing device 500 to navigate the device's menu structure. User interface 524 can be indicators or a series of buttons, switches, or other selectable controls that are manipulated by a user of the printing device. Display panel 526 is a graphical display that provides information regarding the status of printing device 500 and the current options available to a user through the menu structure.

Although shown separately, some of the components of printing device 500 can be implemented in an application specific integrated circuit (ASIC). Additionally, a system bus (not shown) typically connects the various components within printing device 500. A system bus can be implemented as one or more of any of several types of bus structures, including a memory bus or memory controller, a peripheral bus, an accelerated graphics port, or a local bus using any of a variety of bus architectures.

Although power supply adjustment has been described in language specific to structural features and/or methods, it is to be understood that the subject of the appended claims is not necessarily limited to the specific features or methods described. Rather, the specific features and methods are disclosed as exemplary implementations of power supply adjustment.

The invention claimed is:

1. A printing device, comprising:

one or more pens configured to deposit an imaging medium on a print media;

a power supply configured to generate a voltage output that is coupled to power the one or more pens;

an integrated circuit configured to generate a pulse width modulated control signal, the integrated circuit configured external to the power supply; and a voltage adjustment circuit configured to receive the pulse width modulated control signal and generate a difference voltage to adjust the voltage output of the power supply, wherein the adjustment circuit includes an integrator circuit configured to generate the difference voltage, and wherein the integrator circuit includes a buffer circuit configured to receive the pulse width modulated control signal, and includes a DC filter configured to filter the pulse width modulated control signal.

2. A printing device as recited in claim 1, wherein the integrated circuit is further configured to generate the pulse width modulated control signal such that the power supply voltage output is adjusted to correspond to a desired print quality of the printing device.

3. A printing device as recited in claim 1, wherein the voltage adjustment circuit is further configured to generate the difference voltage to increase the voltage output of the power supply.

4. A printing device as recited in claim 1, wherein the voltage adjustment circuit is further configured to generate the difference voltage to decrease the voltage output of the power supply.

5. A printing device as recited in claim 1, wherein the voltage adjustment circuit includes a feedback network configured to generate a feedback voltage.

6. A printing device as recited in claim 1, wherein the voltage adjustment circuit includes a feedback network configured to generate a feedback voltage, and wherein:

the feedback network includes a voltage divider circuit configured to divide the voltage output from the power supply down to the feedback voltage that is applied to the power supply; and the DC filter is configured to generate the difference voltage to vary the feedback voltage.

7. A printing device as recited in claim 6, wherein the DC filter is further configured to generate the difference voltage to decrease the feedback voltage such that the voltage output of the power supply increases.

8. A printing device as recited in claim 6, wherein the DC filter is further configured to generate the difference voltage to increase the feedback voltage such that the voltage output of the power supply decreases.

9. A printing device as recited in claim 6, wherein the feedback network further includes an RC time constant circuit configured to limit the voltage output during start up of the power supply.

10. A printing device as recited in claim 1, further comprising logic configured to vary the pulse width modulated control signal to control the voltage output received from the power supply.

11. A printing device as recited in claim 1, further comprising logic configured to vary the pulse width modulated control signal to increase the voltage output of the power supply.

12. A printing device as recited in claim 1, further comprising logic configured to vary the pulse width modulated control signal to decrease the voltage output of the power supply.

13. A method, comprising:

receiving an output from a power supply;

determining whether the output corresponds to a predetermined level of component operation;

generating a control signal for input to an adjustment circuit, the control signal being generated external to the power supply; and generating a difference signal according to the control signal to adjust the output of the power supply, wherein generating the difference signal includes:

buffering the control signal with a buffer circuit; and filtering the control signal with a DC filter to generate the difference signal that varies a feedback signal to the power supply.

14. A method as recited in claim 13, wherein generating the difference signal includes generating the difference signal to increase the output of the power supply.

15. A method as recited in claim 13, wherein generating the difference signal includes generating the difference signal to decrease the output of the power supply.

16. A method as recited in claim 13, further comprising reducing the output from the power supply during start up of the power supply with an RC time constant circuit.

17. A method as recited in claim 13, further comprising varying the control signal to control the output received from the power supply.

18. A method as recited in claim 13, further comprising varying the control signal to increase the output received from the power supply.

19. A method as recited in claim 13, further comprising varying the control signal to decrease the output received from the power supply.

20. A method, comprising:

generating a voltage output with a power supply;

coupling the voltage output to powered components of a printing device, the powered components including one or more pens that deposit an imaging medium on a print media when powered to turn-on;

determining whether the voltage output of the power supply corresponds to a predetermined pen turn-on energy;

generating a pulse width modulated control signal for input to a voltage adjustment circuit; and generating a difference voltage with the voltage adjustment circuit to adjust the voltage output of the power supply, wherein generating the difference voltage includes:

buffering the pulse width modulated control signal with a buffer circuit; and filtering the pulse width modulated control signal with a DC filter to generate the difference voltage to vary a feedback voltage to the power supply.

21. A method as recited in claim 20, wherein generating the difference voltage includes generating the difference voltage to increase the voltage output of the power supply.

22. A method as recited in claim 20, wherein generating the difference voltage includes generating the difference voltage to decrease the voltage output of the power supply.

23. A method as recited in claim 20, further comprising dividing the voltage output down to a feedback voltage with a voltage divider circuit.

24. A method as recited in claim 20, further comprising limiting the voltage output from the power supply during start up of the power supply with an RC time constant circuit.

25. A method as recited in claim 20, further comprising varying the pulse width modulated control signal to adjust the voltage output received from the power supply such that the voltage output corresponds to the predetermined pen turn-on energy.

26. A method as recited in claim 20, further comprising varying the pulse width modulated control signal to control the voltage output received from the power supply.

27. One or more computer-readable media comprising computer executable instructions that, when executed, direct a printing device to:

determine whether an output from a power supply corresponds to a predetermined pen turn-on energy that powers one or more pens which deposit an imaging medium on a print media;

generate a control signal for input to an adjustment circuit, the control signal configured to be generated external to the power supply; and generate a difference signal according to the control signal to adjust the output of the power supply, wherein the instructions that execute to generate the difference signal also execute to:

buffer the control signal with a buffer circuit; and filter the control signal with a DC filter to generate the difference signal to vary a feedback voltage to the power supply.

28. One or more computer-readable media as recited in claim 27, further comprising computer executable instructions that, when executed, direct the printing device to generate the difference signal to increase the output of the power supply.

29. One or more computer-readable media as recited in claim 27, further comprising computer executable instructions that, when executed, direct the printing device to generate the difference signal to decrease the output of the power supply.

30. One or more computer-readable media as recited in claim 27, further comprising computer executable instructions that, when executed, direct the printing device to adjust the control signal to control the output from the power supply such that the output corresponds to the predetermined pen turn-on energy.

31. A printing device, comprising:

means to couple a voltage output from a power supply to powered components of a printing device, the powered components including one or more pens that each deposit an imaging medium on a print media when the voltage output is applied;

means to determine whether the voltage output corresponds to a predetermined pen turn-on energy;

means to generate a pulse width modulated control signal for input to a voltage adjustment circuit that generates a difference voltage, wherein the voltage adjustment circuit includes means to buffer the control signal and means to filter the control signal to generate the difference voltage to vary a feedback voltage to the power supply; and means to adjust the voltage output of the power supply based upon the difference voltage and the voltage output.

32. A printing device as recited in claim 31, further comprising means to reduce the voltage output of the power supply during start up of the power supply.

33. A printing device as recited in claim 31, further comprising means to adjust the pulse width modulated control signal to control the voltage output of the power supply such that the voltage output corresponds to the predetermined pen turn-on energy.

34. A printing device as recited in claim 31, further comprising means to adjust the pulse width modulated control signal to increase the voltage output from the power supply.

35. A printing device as recited in claim 31, further comprising means to adjust the pulse width modulated control signal to decrease the voltage output from the power supply.

* * * * *